US009980556B2

(12) United States Patent
Goff

(10) Patent No.: US 9,980,556 B2
(45) Date of Patent: May 29, 2018

(54) FLOOR CLEANING IMPLEMENT WITH IMPROVED DRIVING INTERFACE FOR USE WITH A FLOOR MAINTENANCE MACHINE

(71) Applicant: RPS Corporation, Racine, WI (US)

(72) Inventor: Sean K. Goff, Breckenridge, CO (US)

(73) Assignee: RPS Corporation, Racine, WI (US)

( * ) Notice: Subject to any disclaimer, the term of this patent is extended or adjusted under 35 U.S.C. 154(b) by 437 days.

(21) Appl. No.: 14/712,380

(22) Filed: May 14, 2015

(65) Prior Publication Data

US 2016/0331112 A1 Nov. 17, 2016

(51) Int. Cl.

| | |
|---|---|
| ***A47L 13/00*** | (2006.01) |
| ***A47L 11/40*** | (2006.01) |
| ***A46B 13/00*** | (2006.01) |
| ***A46B 13/02*** | (2006.01) |

(52) U.S. Cl.

CPC ..... *A46B 13/008* (2013.01); *A46B 13/02* (2013.01); *A47L 11/4038* (2013.01); *A47L 11/4069* (2013.01); *A46B 2200/3066* (2013.01)

(58) Field of Classification Search

CPC ..... A47L 11/4038; A47L 11/4069; A47L 11/283; A47L 11/164; A47L 11/162; A46B 13/008

See application file for complete search history.

(56) References Cited

U.S. PATENT DOCUMENTS

| | | | | |
|---|---|---|---|---|
| 4,866,804 A * | 9/1989 | Masbruch | ..... | A47L 11/164 15/49.1 |
| D441,927 S | 5/2001 | Creecy | | |
| 9,265,397 B2 * | 2/2016 | Larson | ..... | A47L 11/283 |

* cited by examiner

*Primary Examiner* — Shay Karls

(74) *Attorney, Agent, or Firm* — Quarles & Brady LLP

(57) ABSTRACT

A floor cleaning implement, such as a disc brush, for use in a floor maintenance machine includes a core providing a female portion of a mating interface. The female portion has a central recess with a plurality of pockets extending radially outward from the central recess. Each of the plurality of pockets has a head section that is radially distal from the central recess and has a neck section that is radially intermediate the respective head section and the central recess. Each head section is wider in an angular direction than the corresponding neck section.

22 Claims, 17 Drawing Sheets

FLOOR CLEANING IMPLEMENT WITH IMPROVED DRIVING INTERFACE FOR USE WITH A FLOOR MAINTENANCE MACHINE

CROSS-REFERENCE TO RELATED APPLICATION

Not applicable.

STATEMENT OF FEDERALLY SPONSORED RESEARCH OR DEVELOPMENT

Not applicable.

BACKGROUND

This invention relates to equipment for floor maintenance machines and, in particular, to floor cleaning implements, such as disc brushes or other scrubbing or polishing pads, for floor maintenance machines.

Floor maintenance machines or scrubbers provide an industrial strength way to clean dirty floor surfaces. Typically, an operator directs a floor maintenance machine over the surface to be cleaned by steering or guiding the floor maintenance machine. The large rotating brushes of the floor maintenance machine directly contact the floor surface to, with the help of the supplied cleaning liquid, loosen debris that is on the surface of the floor. Often, this debris is lifted from the floor and is then contained in a collection chamber on the floor maintenance machine.

The rotary brushes of these floor maintenance machines may take different forms. In some forms, the rotary brushes are axial face brushes or disc brushes in which the bristles are all generally parallel with the axis of brush rotation and the ends of the bristles are directed downward to contact the floor. In other forms, the rotary brushes are horizontal cylindrical brushes which rotate about an axis of rotation that is generally parallel with the surface to be cleaned. These brushes each provide a different type of cleaning action. Floor maintenance machines may incorporate one or both of these types of brushes as well as potentially other types of cleaning or scrubbing implements.

With reference being made to FIG. 2A-2E, a prior art disc brush 110 is illustrated having a brush face 112 for contact with the floor. This prior art disc brush 110 has a core 114 with a female portion 116 which is best illustrated unobstructed in FIGS. 2B and 2E. To permit this disc brush 110 to be rotationally driven about a central axis and to also provide a gimbal-like mechanism to permit the brush 110 to adjust to irregularly angled floor surfaces, this female portion 116 mates with a male portion 118 provided by a driver 120 as best illustrated in FIGS. 2A, 2C, and 2D. The star-shaped outer periphery 122 of the driver 120 provides eight teeth that nest into the star-shaped inner periphery 124 of the female portion 116 of the disc brush 110. As best illustrated in the top-down view of the interface in FIG. 2C, the star-shaped outer periphery 122 does not perfectly correspond in shape to the star-shaped inner periphery 124, as the troughs of the teeth are slightly deeper in the driver 120 than they are in the disc brush 110. Nonetheless, the profiles are shaped such that, upon axial rotation of the driver 120 by an attached motor 126, the slanted surfaces of the star-shaped outer periphery 122 of the driver 120 come into contact with the star-shaped inner periphery 124 of the disc brush 110 such that the angle of contact is slightly greater than 90 degrees with respect to the radial direction (i.e., a line perpendicular to a point of contact between the one of the teeth and a corresponding pocket that represents a vector of the applied force is angled somewhat radially outward to a purely angular direction having no radial component).

SUMMARY OF THE INVENTION

While the contact angles provided by the profiles of the inner and outer peripheries of the male and female mating portions in this prior art brush are sufficient to enable the rotation of the disc brush, they may be prone to slippage. Because the driver is typically a more structurally robust product and the disc brush is consumable, the driver may be made from a strong material (such as, for example, brass) while the core of the disc brush may be fabricated from a polymeric material. Over time and at the contact angles illustrated, the driver may be prone to slip relative to the disc brush, particularly if the female portion wears over time. Moreover, it can be observed that the area of the disc brush that receives the brunt of the driving force is a relatively unsupported wall (being somewhat spaced from the outer angularly abutting radial ribs) and over time this wall may become fatigued or wear.

Because the disc brush is the consumable item, it will eventually need replacement. However, from a customer satisfaction perspective, it is far better for the disc brush (or comparable floor cleaning implement) to demand replacement as the result of the floor contacting surface (i.e., the brush face) having been worn, than as a result of mechanical failure at the driving interface. While the consumption of the part due to the floor contacting surface is expected and anticipated by the purchaser, a failure at the driving interface is often perceived to be a manufacturing issue with the floor cleaning implement, even if it occurs late in the service life of the floor cleaning implement.

Thus, a stronger and more robust driving interface might provide a significant benefit to both producers of consumable floor cleaning implements and purchasers thereof.

Disclosed herein are improvements to driving interfaces that can improve the usable life of a floor cleaning implement. This may be achieved, in part, by reshaping the profiles of the female and mating portions to alter the angle of contact during driving and to provide better interlocking features that reduce the likelihood of slippage during driving or failure at the driving interface.

According to one aspect, a floor cleaning implement is provided for use in a floor maintenance machine. The floor cleaning implement has a core providing a female portion of a mating interface (the male portion may be found on the driver of the floor maintenance machine itself). The female portion of the mating interface includes a central recess with a plurality of pockets extending radially outward from the central recess. Each of the plurality of pockets has a head section that is radially distal from the central recess and has a neck section that is radially intermediate the respective head section and the central recess. Each head section is wider in an angular direction than the corresponding neck section.

The interface may be shaped such that the driver can rotationally drive the floor cleaning implement about an axis of rotation, such that a type of gimballing mechanism is provided so that the floor cleaning implement can tilt on irregular floors, and such that the floor cleaning implement can be easily attached and detached (as the coupling of the floor cleaning implement to the driver can be somewhat blind on the part of the operator and involve at least a temporary angular tilting of the floor cleaning implement as it is received onto or removed from the driver).

The female portion of the mating interface on the core can be configured to mate with a male portion of a driver of the floor cleaning machine which has a plurality of cogs corresponding to the plurality of pockets. With the male portion of the driver in the female portion of the floor cleaning implement, the rotation of the driver can be used to rotate the floor cleaning implement. To accommodate the connection of the floor cleaning implement to the corresponding driver a retaining structure such as retaining clips may be used, and in such a case, the core may include a pair of clip receiving structures on a top side thereof. The clips may then be received in the clip retaining structure and supported by the core. These clips may then be received around an upper side of the driver to maintain engagement of the female and male mating portions. It should be noted that, in some forms, the core may be connected to another body, and the core and the other body together provide the floor cleaning implement. However, in other forms, it is contemplated that these parts may be integral with one another and formed of a single continuous material.

The pockets may have a regularly occurring pattern. For example, the plurality of pockets may be evenly angularly spaced about a central axis of the central recess. Moreover, each of the plurality of pockets may be symmetrical about a respective plane running centrally therethrough in which the plane also extends through a central axis of the central recess. In one particular form, there may be eight pockets and four planes of symmetry. However, there can be other numbers of pockets and symmetry may not be present in all configurations.

The pockets may have a concavity in their intermediate neck sections that traditionally has not been found in mating interfaces. Put one way, the female portion may be defined (at least in part) by an inner periphery viewable from the top axial side of the core and the head section of each one of the plurality of pockets may include a section of the inner periphery that faces radially outward and away from the central recess. The walls of this inner periphery of the female portion may be vertically aligned (i.e., parallel to the central axis). Put another way, in each of the plurality of the pockets, a minimum angular extent of the neck section at a first fixed radial distance from a central axis of the central recess may be less than a maximum angular extent of the head section at a second fixed radial distance from the central axis of the central recess. With angular extents of this type, a straight radial line drawn between at least one of the ends of the maximum angular extent of the head section and the central axis may not extend through the minimum angular extent of the neck section (i.e., the volume that receives part of the driver), but radial this line may extend through the material of body of the core.

Under such geometric conditions, the head and neck sections of each of the pockets may provide a T-shaped profile (according to one form) or a bulbous profile (according to another form) as viewed axially from a top side of the core. If, for example, pockets have a bulbous profile, then the bulbous profile may include a circular segment extending at least 180 degrees about an axis extending through the respective head section.

The floor cleaning implement may be one of a number of different types of disc-shaped objects that may be used to contact a surface of the floor. In one specific form, the floor cleaning implement may be a disc brush having a brush face that is downwardly facing for contact with a surface to be cleaned. The floor cleaning implement may include a plurality of axially-extending bristles supported by the core that form a brush and the terminal ends of the plurality of axially-extending bristles can define the brush face. In a brush of this type, the brush face may be generally perpendicular to a central axis of the core. It is also contemplated that the floor cleaning implement may be something other than a brush such as, for example, a polishing pad.

To permit gimballing of the floor cleaning implement relative to the floor, the female portion of the mating interface may have a bottom wall that includes a downwardly sloping frusto-conical surface and a centrally-located axially facing surface. The downwardly sloping frusto-conical surface may extend from the plurality of pockets into the central recess and the centrally-located axially facing surface may be located entirely within the recess.

To improve ease of installation of the floor cleaning implement on the driver (or removal therefrom), the driver may be shaped to provide some amount of angling of the floor cleaning implement relative to the driver. This can be done by providing an additional tapering on the bottom side of the cogs to provide clearance so that the female and male mating portions are less prone to snag or catch at relatively low angles of misalignment.

According to another aspect, a disc brush is provided for use in a floor maintenance machine in which the disc brush has a brush face that is downwardly facing for contact with a surface to be cleaned. The disc brush is rotatable about a central axis that is perpendicular to the brush face by a driver of the floor maintenance machine in which the driver includes a plurality of radially-extending cogs. In an axial side of the disc brush opposing the brush face, the disc brush has a recessed portion of a coupling interface which is configured to receive the driver. The disc brush includes a core providing the female portion including a central recess with a plurality of pockets extending radially outward from the central recess that are shaped to correspond to the plurality of radially-extending cogs of the driver. Each of the plurality of pockets has a head section that is radially distal from the central recess and has a neck section that is radially intermediate the respective head section and the central recess. In each of the plurality of the pockets, a minimum angular extent of the neck section at a first radial distance passing through the neck section is less than a maximum angular extent of the head section at a second radial distance passing through the head section.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION OF THE PREFERRED EMBODIMENTS

Although the content of this application primarily relates to improvements to floor cleaning elements, such as disc brushes, to provide some content for the application, an exemplary floor cleaning machine will be first described with reference to FIGS. 1A and 1B. With this usage context in mind, some specific forms of the improved floor cleaning implements will then be described with reference to FIGS. 3A-3E and 4A-4E.

Figure 1A:
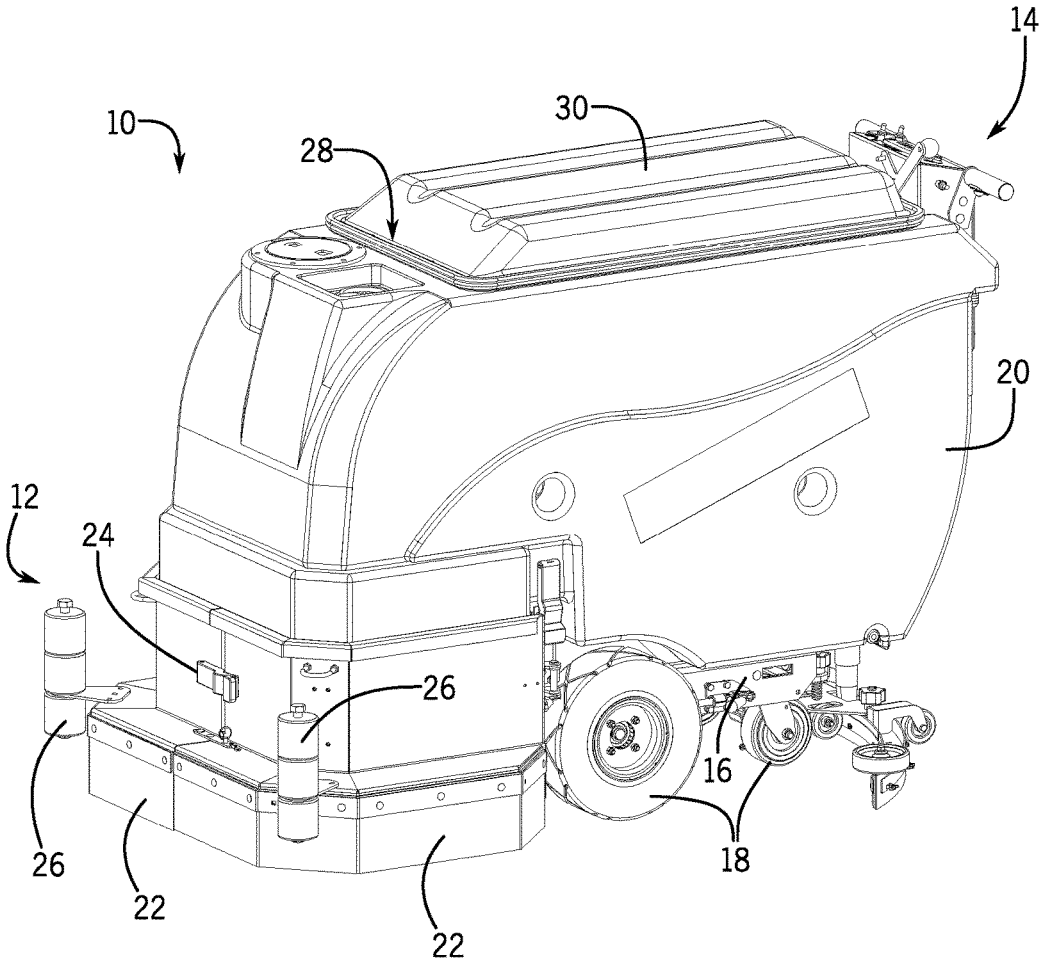
FIG. 1A is a perspective view of a walk-behind floor maintenance machine.
Figure 1B:
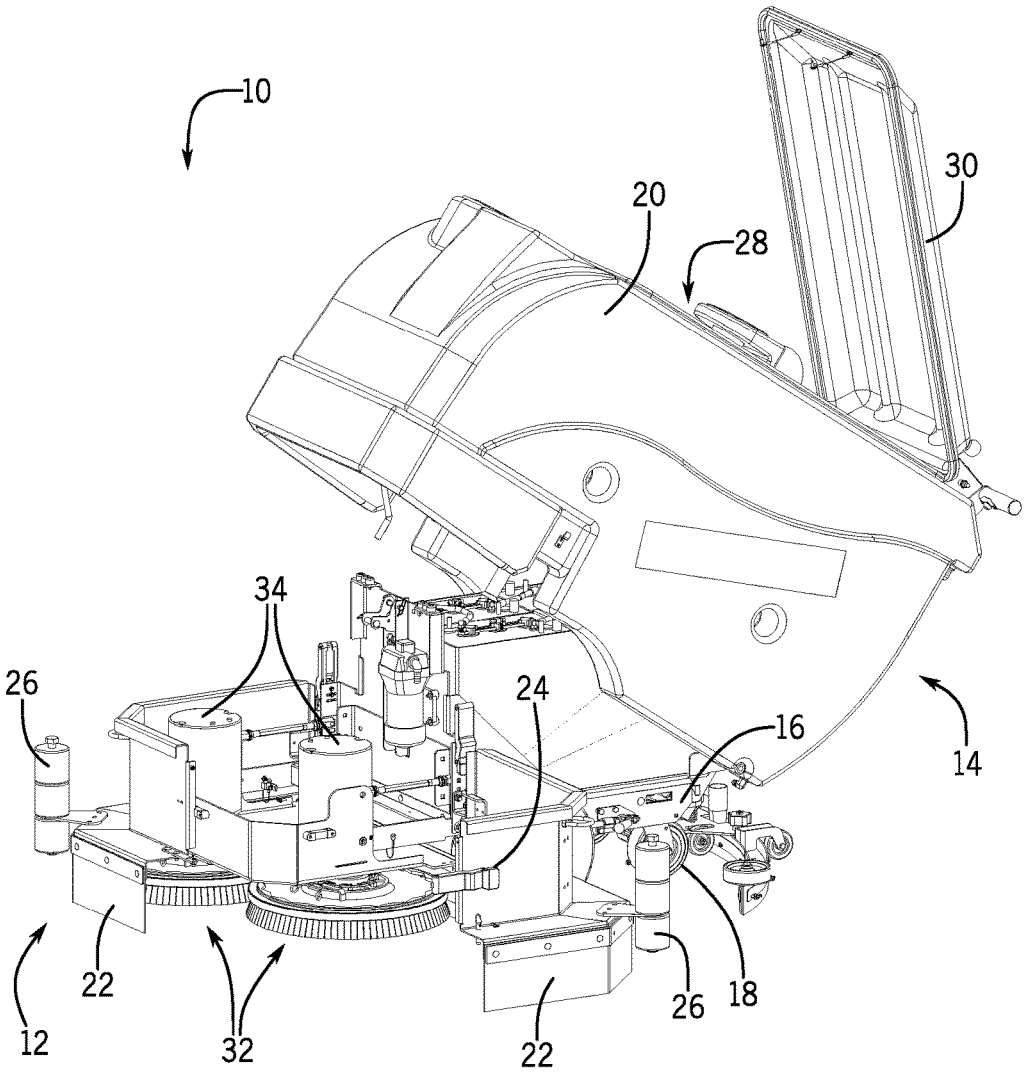
FIG. 1B is a perspective view of a walk-behind floor maintenance machine with the tanks lifted and one shroud open to reveal the floor cleaning implements.

Referring to FIGS. 1A and 1B, an exemplary floor cleaning machine is shown for the cleaning of floors. The floor scrubber 10 is a walk-behind floor scrubber, such as those manufactured by R.P.S. Corporation of Racine, Wis. However, the floor scrubber 10 could potentially be any kind of floor scrubber 10 including both walk-behind or riding-type floor scrubbers.

In the form shown, the floor scrubber 10 has a front end 12 and a rear end 14 behind which an operator may stand. A chassis 16 extends between the front end 12 and the rear end 14. The chassis 16 has a set of wheels 18 mounted on the bottom side thereof for contact with the floor. The body of the chassis 16 is largely covered by a liftable tank 20. The liftable tank 20 covers a number of the internal components of the floor scrubber 10 (e.g., the battery).

At the front end 12 of the floor scrubber 10 and near the bottom of the liftable tank 20, a pair of shrouds 22 partially surrounds a pair of rotary brushes 32 driven by motors 34 for scrubbing the floor. The pair of shrouds 22 can hingedly swing outward to expose the rotary brushes 32 for maintenance or repair. The pair of shrouds 22 are held closed by a latch 24 and each include a set of bumpers 26 that prevent damage should the floor scrubber 10 bump into a stationary object.

As described above with respect to FIGS. 2A-2E, these rotary brushes may be conventional axial disc brushes having counter rotational directions (that is, one driven clockwise and the other driven counter-clockwise). However, it is contemplated that the axial disc brushes may also have improved mating interfaces as illustrated in FIGS. 3A-3E and 4A-4E, which will be described in greater detail later below.

The liftable tank 20 has a recovery chamber 28 formed therein as well as another internal water/solution tank formed in the inter-wall space of the liftable tank 20. A removable cover 30 is placed over the recovery chamber 28 and, when lifted, provides access to the recovery chamber 28. The recovery chamber 28 serves as a tank for holding the collected used fluid, foam, and debris after it has been used to clean the floor, collected at the squeegee 38, and has been vacuumed up from the floor.

Although it cannot be seen in FIG. 1, the internal water/solution tank may include a fluid passageway that extends to an outlet. The outlet is placed proximate the rotary brushes such that the outlet can dispense cleaning fluid from the internal water/solution tank to the floor or rotary brushes 32 during operation of the floor scrubber 10.

The floor scrubber 10 additionally includes a number of other optional parts. A drain hose (not shown) is connected to the side of the floor scrubber 10 and can be lowered to drain the recovery chamber 28. A squeegee 38 extends across the rear end 14 of the floor scrubber 10 to contain and recover any cleaning fluid applied to the floor. In some forms of the floor scrubber 10, a vacuum system may be mounted to or proximate to the squeegee 38 to collect excess fluid.

Turning now to FIGS. 3A-3E and 4A-4E, two exemplary floor cleaning implements are respectively illustrated in which disc brushes are illustrated having bulbous and T-shaped teeth or engagement elements, respectively. It should be appreciated that while disc brushes are illustrated, these disc brushes are generally representative of floor cleaning implements and that a similar mating structure to those illustrated might be employed in other types of floor cleaning implements such as, for example, but not limited to, polishing pads. It will be further appreciated that only a single motor and floor cleaning implement is illustrated in these figures and that, as noted before, such floor cleaning implements are typically paired together and driven by motors have different spin directions (one clockwise, one counter-clockwise).

Looking first at FIGS. 3A-3E, a disc brush 210 is illustrated. Generally speaking, the disc brush 210 has a brush face 212 that is downwardly facing for contact with a floor surface to be cleaned or otherwise maintained. This brush face 212 is formed by a plurality of bristles that extend generally along an axial direction to terminal ends that will generally define the brush face 212. While these bristles extend primarily in an axial direction (as this is an axial face brush and not a cylindrical brush), there may also be some slight radial component to the direction of bristle extension.

On an opposite axial side of the disc brush 210 from the brush face 212, there is a female portion 214 of a mating interface which is generally upwardly facing.

Figure 3A:
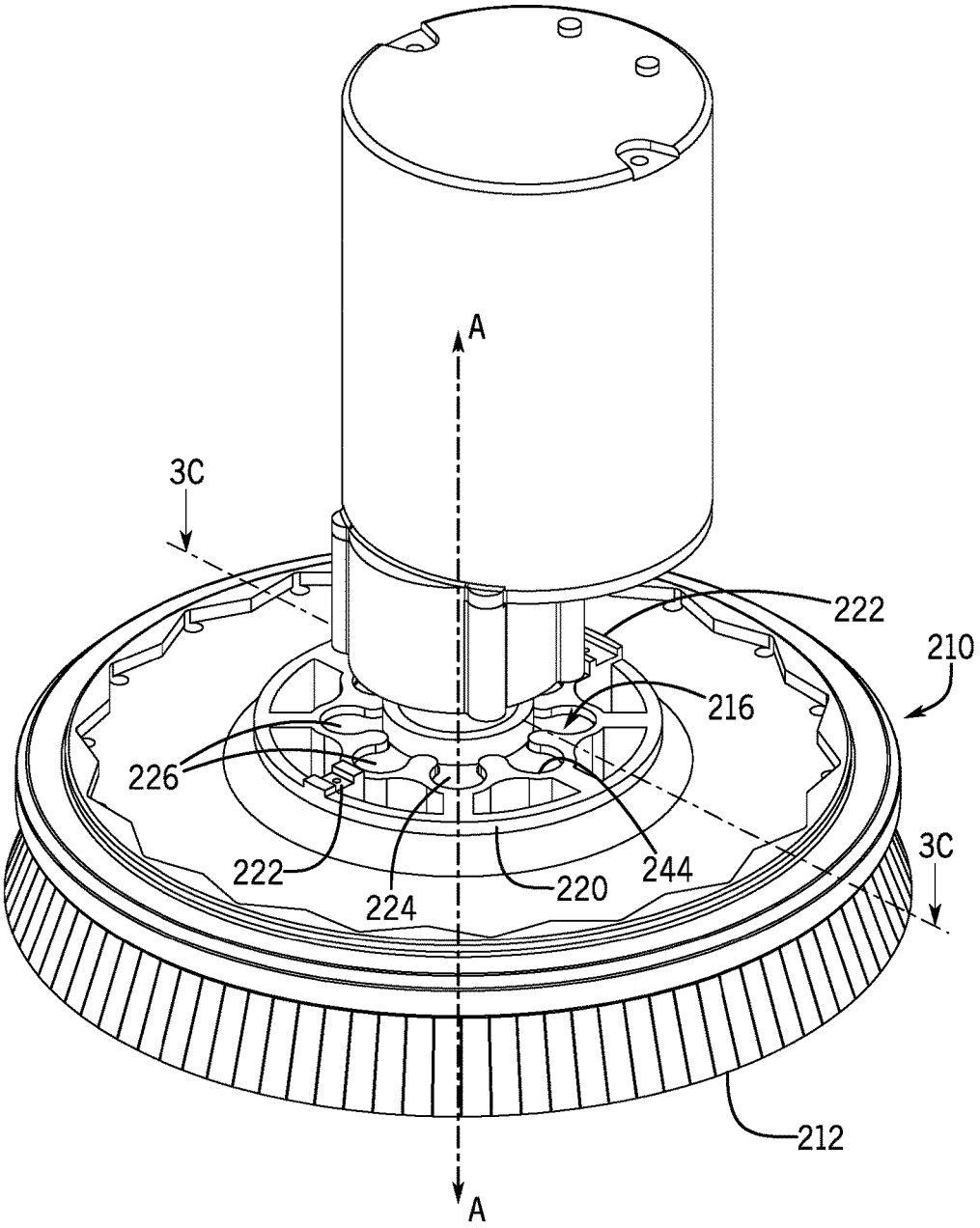
FIG. 3A is a perspective view of a first embodiment of a disc brush including bulbous pockets on the mating interface (and omitting the retention clips on the disc brush) in which a driver of the floor maintenance machine is received in the female portion of the disc brush.
Figure 3B:
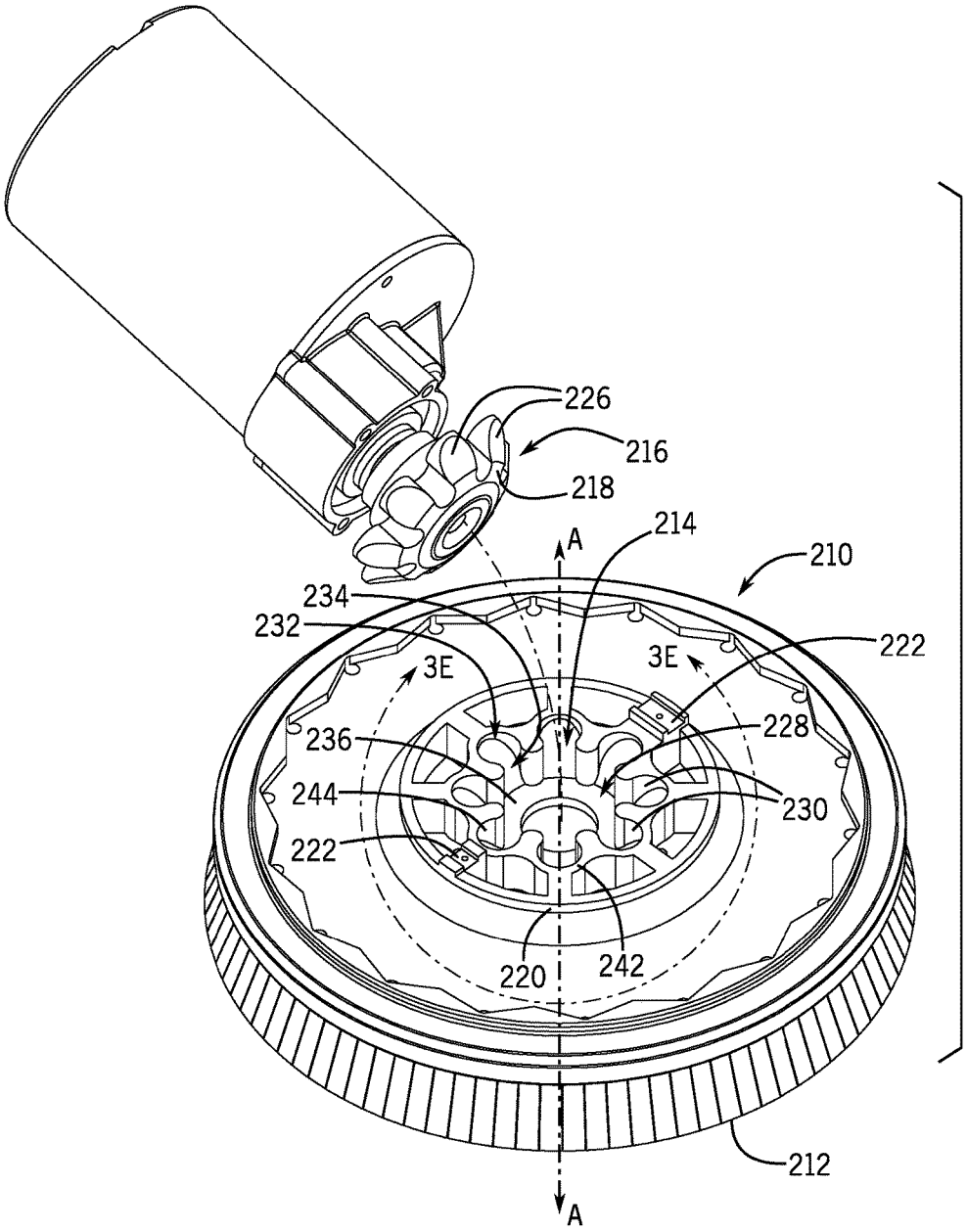
FIG. 3B is a perspective view of the disc brush of FIG. 3A in which the driver and corresponding motor are exploded therefrom to illustrate the mating interfaces of the disc brush and the driver.
Figure 3C:
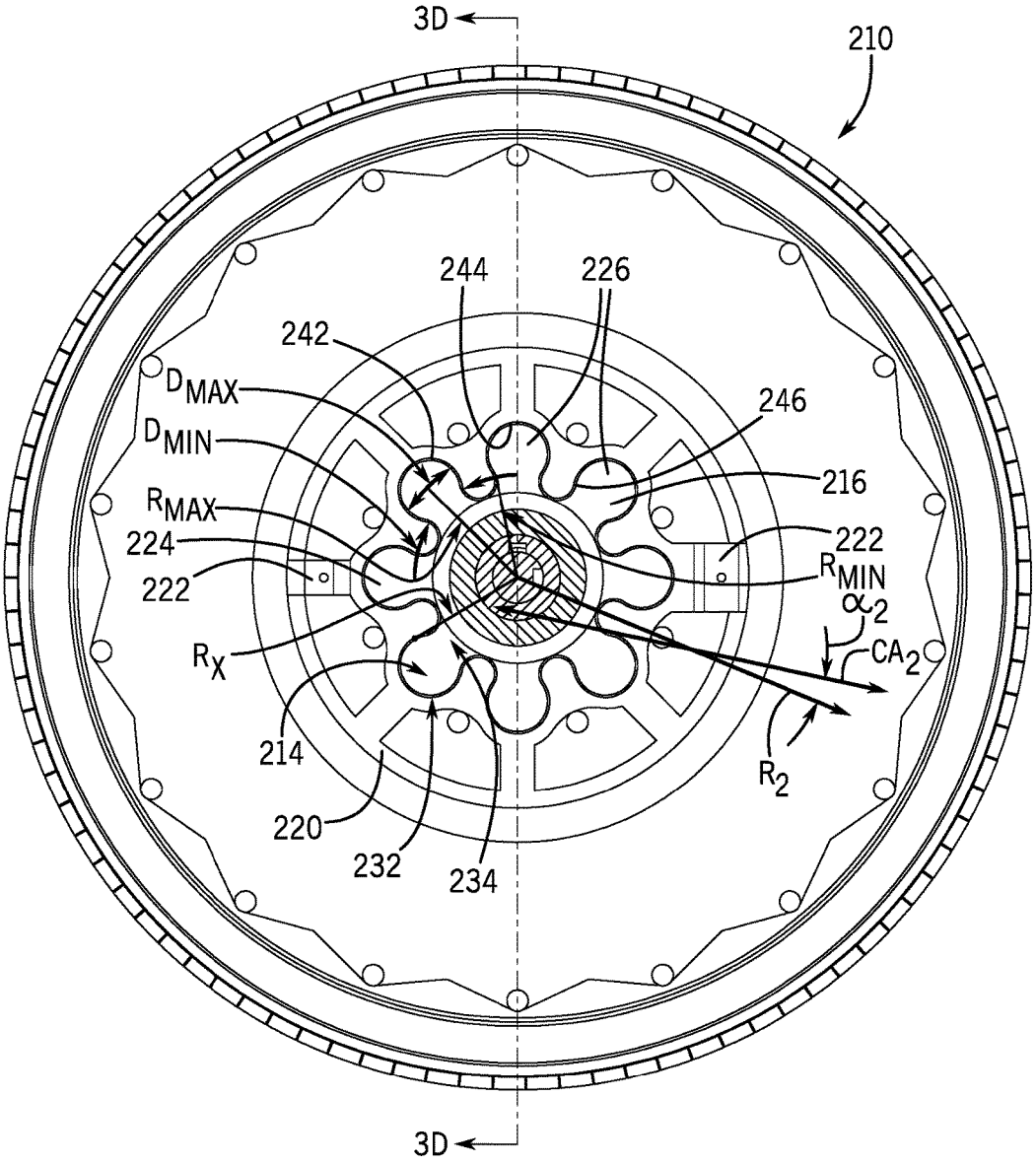
FIG. 3C is a cross-sectional top-down view of the disc brush of FIG. 3A with the driver received therein taken through line 3C-3C of FIG. 3A.
Figure 3D:
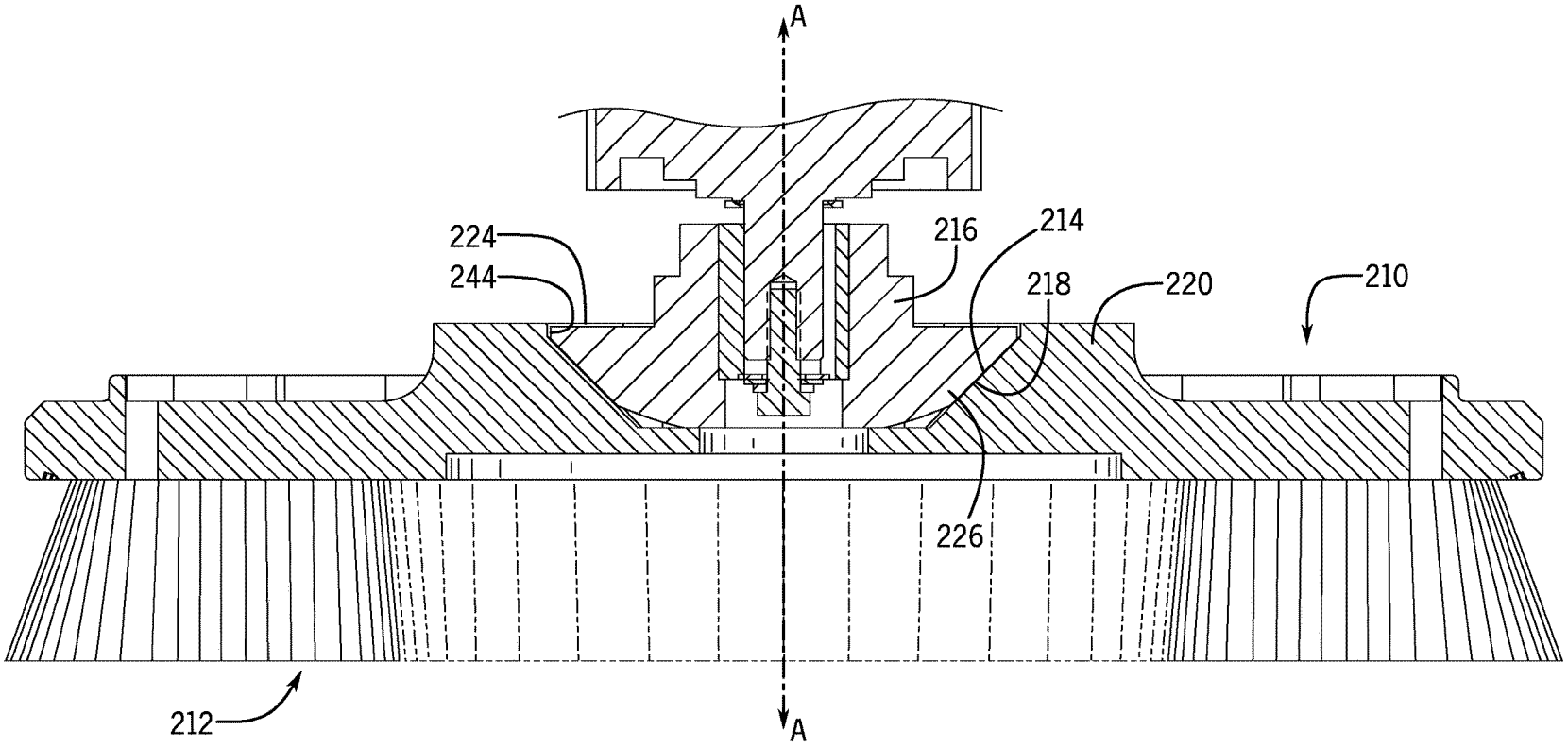
FIG. 3D is a cross-sectional side view of the disc brush of FIG. 3A with the driver received therein taken through line 3D-3D of FIG. 3C.

The female portion 214, which is capable of reception on a male portion 216 of a driver 218 along a central axis A-A (which is also the axis of rotation from the disc brush 210) to establish a mating interface between the driver 218 and the disc brush 210. By engagement with a driver 218 of the floor maintenance machine as illustrated in FIGS. 3A, 3C, and 3D, the disc brush 210 can be rotatably driven about the central axis A-A and which is generally perpendicular to the brush face 212 to cause the bristles to orbit the central axis A-A to circularly brush the floor. For the sake of clarity, it is noted that the brush face 212 is said to be "generally" perpendicular to the axis of rotation A-A because the terminal ends of the bristles may not form a perfectly flat plane and, accordingly, there may be some slight curvature to the brush face 212 depending on the particular configuration of the disc brush 210. Moreover, upon contact with the floor, the bristles may splay or spread and that makes this geometric description one of a relative nature. Further yet, it should be appreciated that the brush interface can act as a gimbal, such that the brush can slightly angularly tilt with respect to the floor or the axis of rotation to permit cleaning of uneven or irregular floors.

Based on its location, the female portion 214 can be said to be on a core 220 of the disc brush 210. It will be appreciated that the core 220 of the disc brush 210 on which the female portion 214 of the mating interface is provided may be a separate component from the rest of the body of the disc brush 210. For example, the core may be separately fabricated from a secondary disc part supporting the bristles and the core may be press fit, fastened, or otherwise connected to the secondary disc part such that they rotate unitarily with one another. However, it is also contemplated that the core may be integral with the rest of the body, and the component on which the female portion 214 of the mating interface is formed may also directly support the bristles. Further, the core 220 includes a pair of clip receiving structures 222 on a top side thereof on opposing radial sides of the female portion 214. While not illustrated, clips are received between these clip receiving structures 222 which can be temporarily opened to permit the driver 218 and the disc brush 210 to be mated together and then closed to retain the driver 218 and the disc brush 210 together (by, for example, preventing the male portion 216 of the driver 218 to be withdrawn from the female portion 214 by having the clip positioned to immediately interfere with the upper surface 224 of the driver 218 upon any attempt at separation). This prevents the brushes 210 from falling off when the deck is raised up, but still permits the gimballing of the brush 210 on the driver 218.

In any event, the female portion 214 and the male portion 216 of the mating interface differ from the mating interface illustrated in the prior art mating interface of FIGS. 2A-2E. As best seen in FIGS. 3B and 3C, the driver 218 includes a plurality of radially-extending cogs 226 which differ from the star-shaped profile of the teeth from the prior art brush 110. Similarly, the female portion 214 of the mating interface on the core 220 is configured to mate with the male portion 216 of the driver 218 and has a generally corresponding negative shape to the driver 218. Even with this mating, the gimbal between the brush 210 and the driver 218 remains.

Figure 3E:
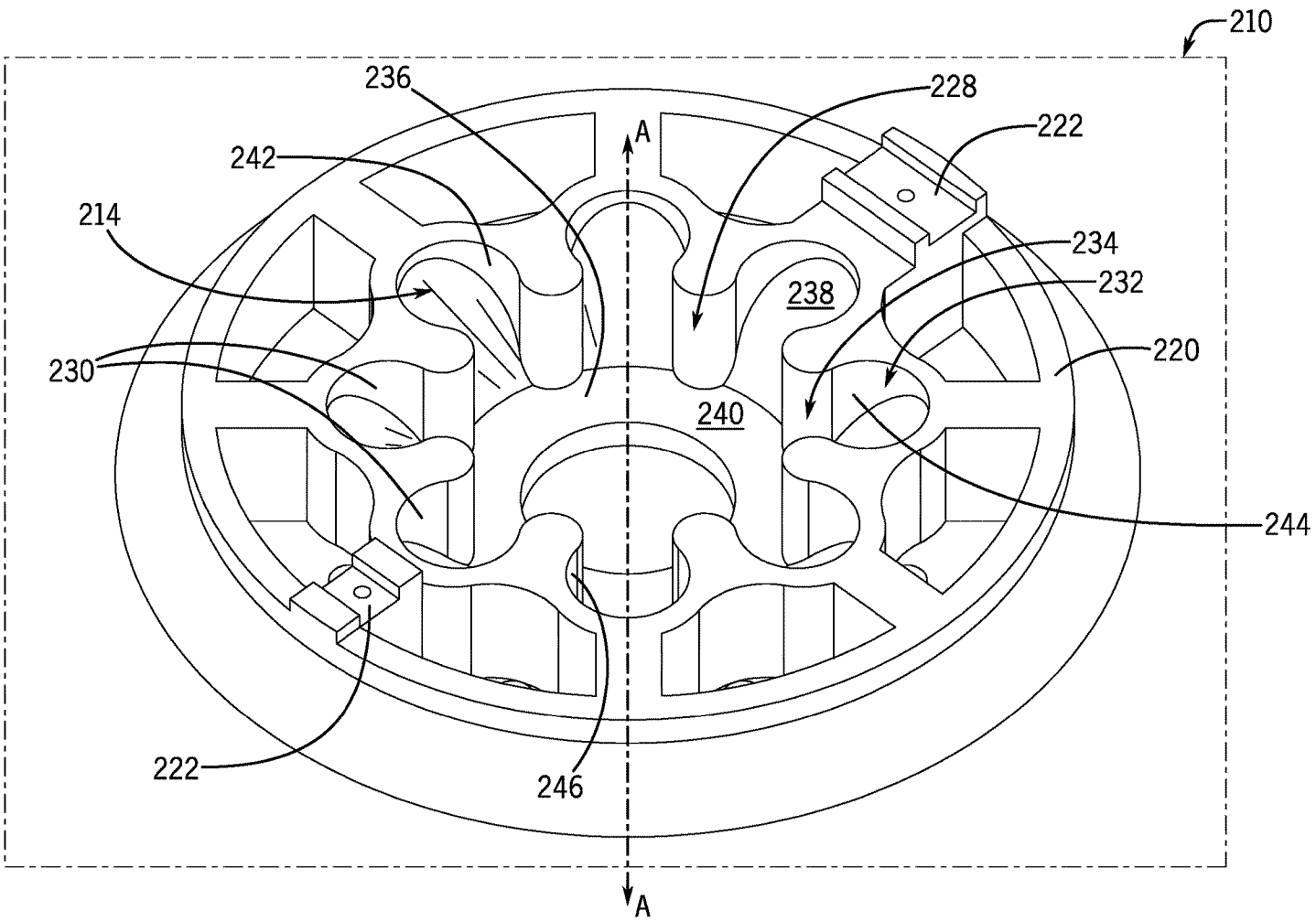
FIG. 3E is a detailed perspective view of the female portion of the mating interface of the disc brush of FIG. 3A.

As best illustrated in FIGS. 3B and 3E, the female portion 214 of the mating interface includes a central recess 228 with a plurality of pockets 230 that extend radially outward from the central recess A-A that are shaped to correspond to the plurality of radially-extending cogs 226 of the driver 218. Each of the plurality of pockets 230 has a head section 232 that is radially distal from the central recess 228 and further has a neck section 234 that is radially intermediate and positioned between the respective head section 232 and the central recess 228. The female portion 214 of the mating interface includes a bottom wall 236 including a downwardly sloping frusto-conical surface 238 that transitions into a centrally-located axially facing surface 240, as best seen in FIG. 3E.

In the particular form illustrated, there are eight pockets in the plurality of pockets 230 and these pockets are evenly angularly spaced about the central axis A-A of the central recess 228. Since there are eight pockets in the form illustrated, this means the centerline to centerline angle between the pockets is 45 degrees. Moreover, in the form illustrated, each of the plurality of pockets 230 is symmetrical about a respective plane that runs centrally therethrough in which the plane (of which there are four in this specific instance) also extends through the central axis A-A of the central recess 228. It will readily be appreciated that although eight symmetrical pockets are shown in the particular embodiment, that the number of pockets, their symmetries (both as separate pockets and with respect to one another as a group), and their angular orientations with respect to one another might be varied, so long as the mating driver is correspondingly shaped.

Notably, in the particular form illustrated in FIGS. 3A-3B, the head section 232 of each of the plurality of pockets 230 has a bulbous profile as viewed axially from a top side of the core. The bulbous profile includes a circular segment 242 extending at least 180 degrees about an axis extending through the respective head section 232. Because the adjacent neck section 234 is narrow relative to the head section 232, in the form illustrated, the circular segment 242 is estimated to be between 180 and 270 degrees.

It should be appreciated that while the bulbous profile is shown as being circular, the bulbous profile need not be this specific circular shape or even necessarily circular. Other curvatures may be used. For example, one such alternative geometry is illustrated in FIGS. 4A-4E in which the head section and neck section define a T-shape.

Regardless of the specific geometry of the head section 232 (two geometries of which are illustrated in FIGS. 3A-3E and FIGS. 4A-4E, respectively), the head section 232 should have a larger or wider angular extent than the corresponding neck section 234. Put a slightly different way and with specific reference being made to the annotations in FIG. 3C, in each of the plurality of the pockets 230, a minimum angular extent $D_{MIN}$ of the neck section 234 at a first radial distance $R_{MIN}$ passing through the neck section 234 is less than a maximum angular extent $D_{MAX}$ of the head section 232 at a second radial distance $R_{MAX}$ passing through the head section 232. The first radial distance $R_{MIN}$ and the second radial distance $R_{MAX}$ are measured from the central axis A-A of the central recess 228, are different from one another (i.e., the first radial distance is greater than the second radial distance), and are "fixed" meaning that the measurement for a particular radial distance occurs at a single radial distance and not along an arc of varying radial distances with respect to the central axis A-A.

Given this geometry and again looking at the female portion 214 from the top-down axial view of FIG. 3C, when a straight radial line $R_X$ is drawn between at least one of the ends of the maximum angular extent of the head section 232 and the central axis A-A, this straight radial line $R_X$ does not extend through the minimum angular extent of the corresponding neck section 234. Instead, this straight radial line $R_X$ necessarily extends through a solid volume or body of the core 220. It is contemplated that each pocket may have a pair of straight radial lines that each might have similar properties to those described above (not extending through the minimum angular extent of the neck section while necessarily extending through a solid volume of the core) when these two lines are drawn between the central axis A-A and either one of the two respective ends of the maximum angular extent of the head section 232.

Further describing the geometry of the female portion 214 of the mating interface, the female portion 214 of the mating interface in the particular illustrated embodiments can be defined, at least in part, by an inner periphery 244, which may be a shaped wall that is parallel with the axis of rotation and extends along a shaped loop around the central axis A-A. Because, as noted above, the head section 232 is generally wider than the neck section 234, this can mean that the head section 232 of each one of the plurality of pockets 230 includes a section 246 of the inner periphery 244 that faces radially outward and away from the central recess 228. In contrast, all face sections or segments of the star-shaped profile of the prior art female portion extend back into or toward the central recess from which the teeth of the star emanate.

Put still yet another way, the neck sections 234 establish radial undercuts. These undercuts occur as the pockets 230 extend radially inward. While many teeth in rotatable objects such as gears only narrow as they extend radially outward, these pockets 230 and their corresponding cogs 226 from the driver 218 intermediately narrow in the neck section 234.

No matter how these geometries are described, it should be recognized that this mating profile with a wider head section than neck section offers many benefits over the prior art conventional mating interface. Among other things, this improved geometry eliminates the possibility of slippage of the driver relative to the floor cleaning implement found in the shallower star profile from FIGS. 2A-2E, because the wider head section cannot possibly pass through the narrower neck section. Further, the geometric profile alters the manner in which the load is transferred from the driver to the disc brush. Rather than having a force vector that is directed out and away, the concavity of the parts at the mating interface can be used to keep the resultant force vector more true to a perpendicular direction to the radial direction. Still yet, the concavity of the neck section can help to distribute the force over a greater contact area, reducing the negative effects of a point load. As yet another possible advantage, it is observed that the space between the pockets is generally filled in and not thin-walled, and thus is less prone to deformation and cyclic fatigue over time that could result in pre-mature failure of the mating interface or slippage between the driver and brush.

Figure 2A:
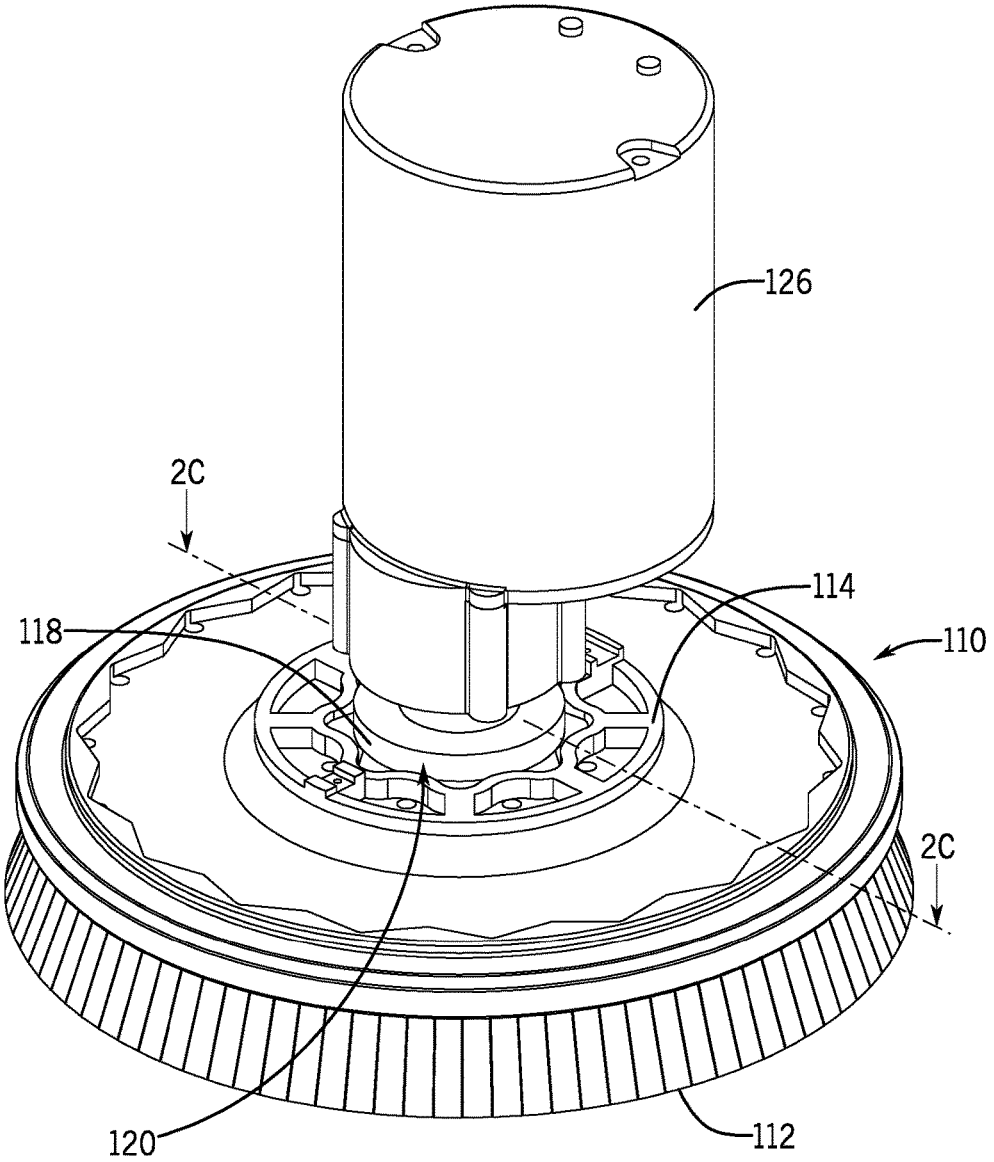
FIG. 2A is a perspective view of a prior art disc brush (omitting the retention clips on the disc brush) having a driver of the floor maintenance machine received therein.
Figure 2B:
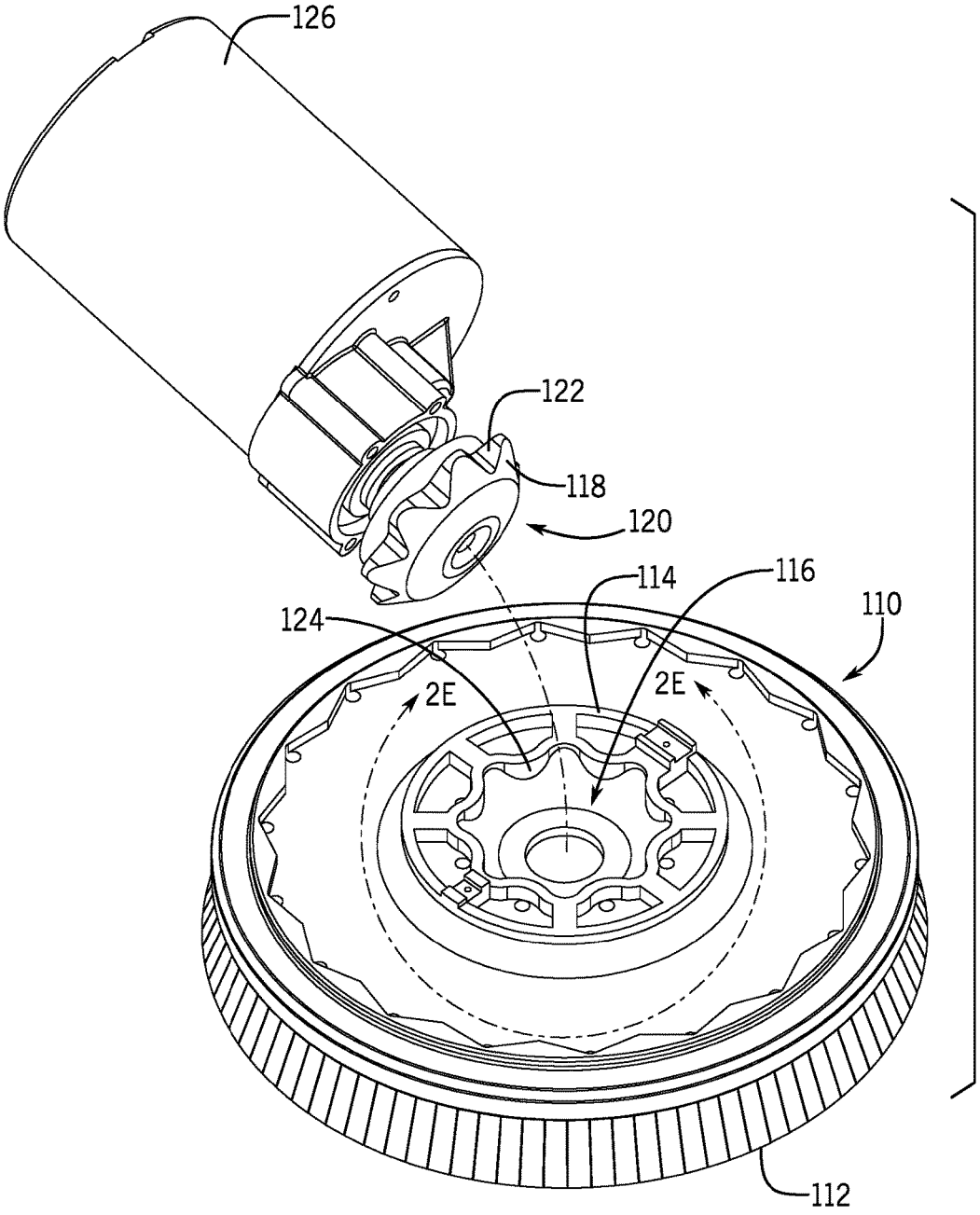
FIG. 2B is a perspective view of the prior art disc brush from FIG. 2A in which the driver and corresponding motor are exploded therefrom to illustrate the mating interfaces of the disc brush and the driver.
Figure 2C:
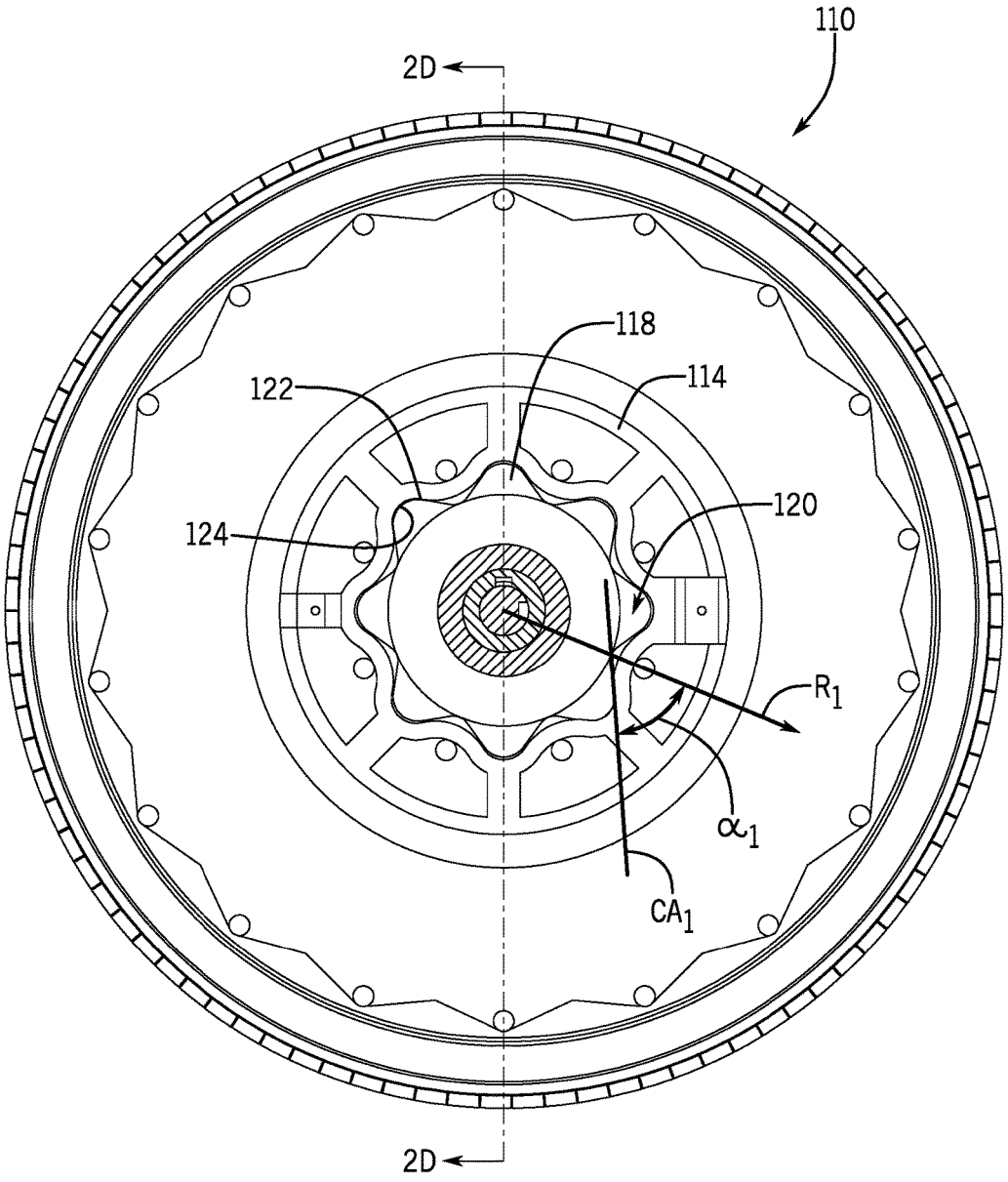
FIG. 2C is a cross-sectional top-down view of the prior art disc brush with the driver received therein taken through line 2C-2C of FIG. 2A.
Figure 2D:
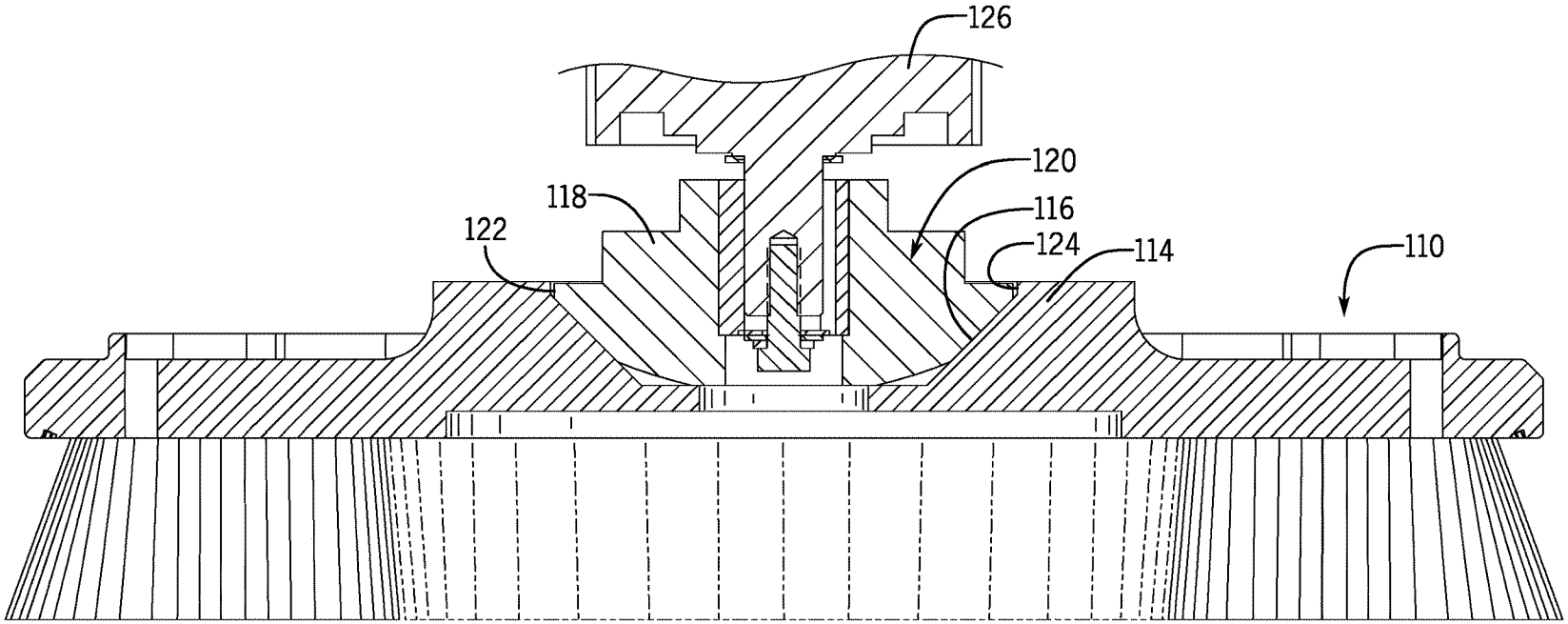
FIG. 2D is a cross-sectional side view of the prior art disc brush with the driver received therein taken through line 2D-2D of FIG. 2C.
Figure 2E:
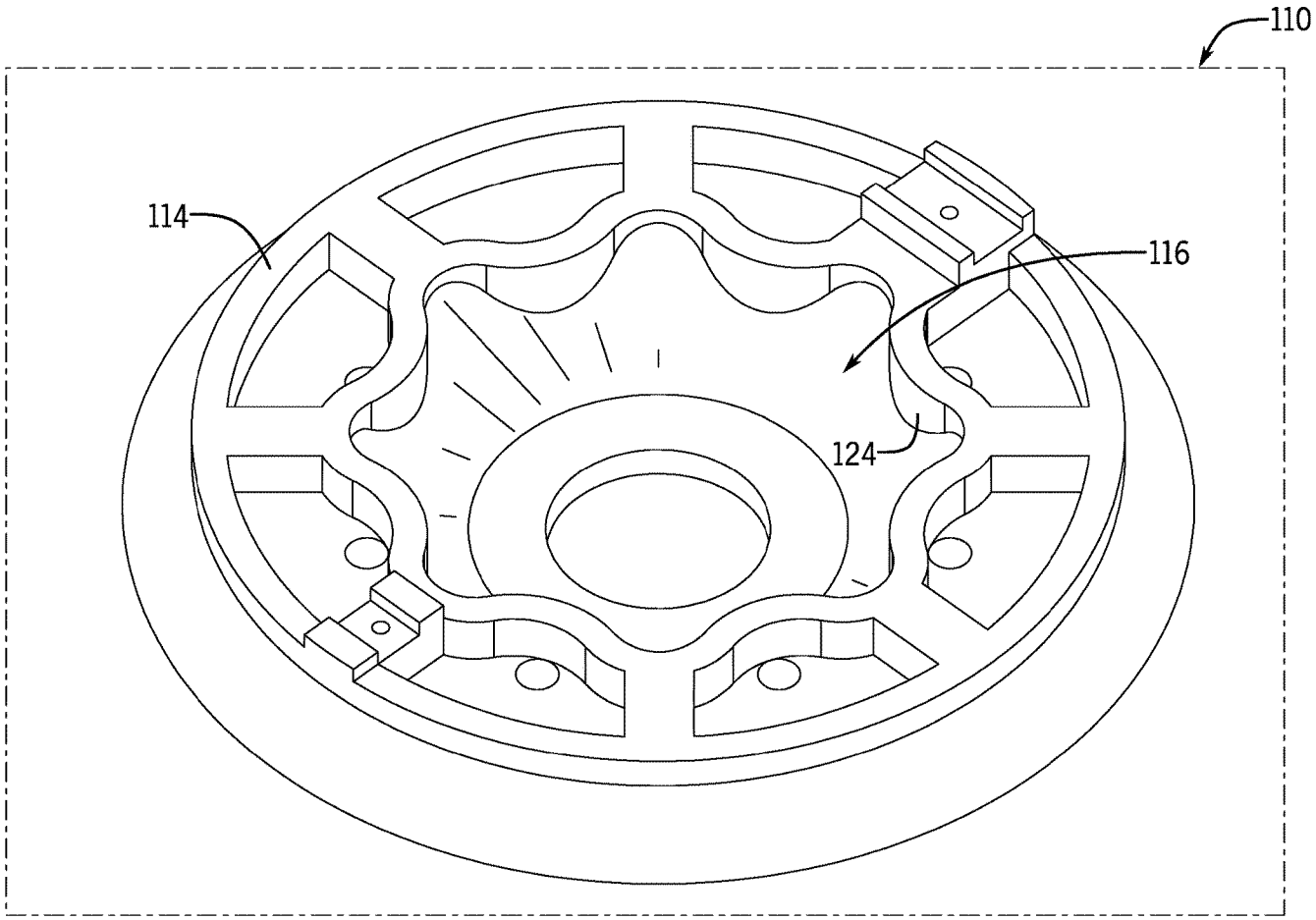
FIG. 2E is a detailed perspective view of the female portion of the mating interface of the prior art disc brush.

Perhaps most notably, this new mating interface geometry alters the angle of contact between the driver and the brush as can be seen from a comparison of FIGS. 2C and 3C. Single representative points of contact are annotated in these figures as now described to illustrate the principle of how this new geometry helps the driver to engage and snag the brush. However, it will be appreciated that a number of these points of contact will exist at the various cog or teeth to transmit the rotational torque from the driver to the brush.

Looking first at FIG. 2C, it can be seen that, with the star-shaped profile of the prior art design, a first angle $\alpha_1$ is defined between the radius $R_1$ (extending through the center of next most forwardly positioned root) and the line $CA_1$. Line $CA_1$ defines a plane perpendicular to the force applied at one of the points of contact if the brush is rotated in a counter-clockwise direction (as viewed from above and with the plane extending into and out of the page). With this geometry of contact, the force vector applied by the driver 120 on the star-shaped inner periphery 124 of the disc brush 110 has a component perpendicular to the radial direction $R_1$ to transmit torque, but also a component that is radially outward from the point of contact. Put yet another way, because there is a radially outward component of the force vector, the $\alpha_1$ angle on the radially outward side lags or is negative relative to the counter-clockwise direction of rotation. This arrangement is prone to slippage and fast-developing wear along the contact surface of the components.

In contrast with the prior art design in FIG. 2C, in the geometry illustrated in FIG. 3C with the driver 218 again being driven in the counter-clockwise direction, a line $CA_2$ defines the plane perpendicular to force between the driver 218 and the brush 210 that also defines a second angle $\alpha_2$ with the radius $R_2$ (again, extending from the center of the next most forwardly positioned root). With this geometry of contact, the force vector applied by the driver 218 on the disc brush 210 has a component perpendicular to the radial direction $R_2$ to transmit torque, but also a component that is radially inward from the point of contact. Again, put another way, this angle $\alpha_2$ can be said to lead or to be positive on the radially outward side of the point of contact. Unlike the prior art arrangement, this undercut type of arrangement causes the cogs or teeth to engage the pockets and cause a type of inter-locking engagement in which rotationally driving the driver 218 does not result in slippage as in the prior art design, but rather causes more robust engagement or snagging on the two components together with one another under rotation.

Turning now to FIGS. 4A-4E, a disc brush 310 is illustrated having pockets with a T-shaped profile as viewed axially from a top side of the disc brush. In FIGS. 4A-4E, 300 series reference numbers will be used to indicate features similar to features found in FIGS. 3A-3E using 200 series numbers. Like numbers are used to describe like features having similar features and function, with the exception of those differences that are either noted in the description that follows or that are apparent from the figures themselves.

The general structure of the disc brush 310 of FIGS. 3A-3E is similar to the disc brush 210 of FIGS. 4A-4E, except that the inner periphery 344 is shaped to provide T-shaped pockets 330 rather than bulbous pockets 230 as were formed by inner periphery 244. In the form illustrated, this means that the head sections 332 of the pockets 330 are more elongated in the angular direction. Nonetheless, the neck sections 334 still have much narrower angular extents (comparing $D_{MAX}$ to $D_{MIN}$ in FIG. 4C) than the head sections 332, such that there is still a section 346 of the inner periphery 344 that faces radially away from the central recess 328.

Because of the difference in the shape of the inner periphery 344, the male portion 316 of the driver 318 (and the cogs 326 specifically) are differently shaped to more closely correspond to the negative shape of the female portion 314 of the mating interface.

Figure 4A:
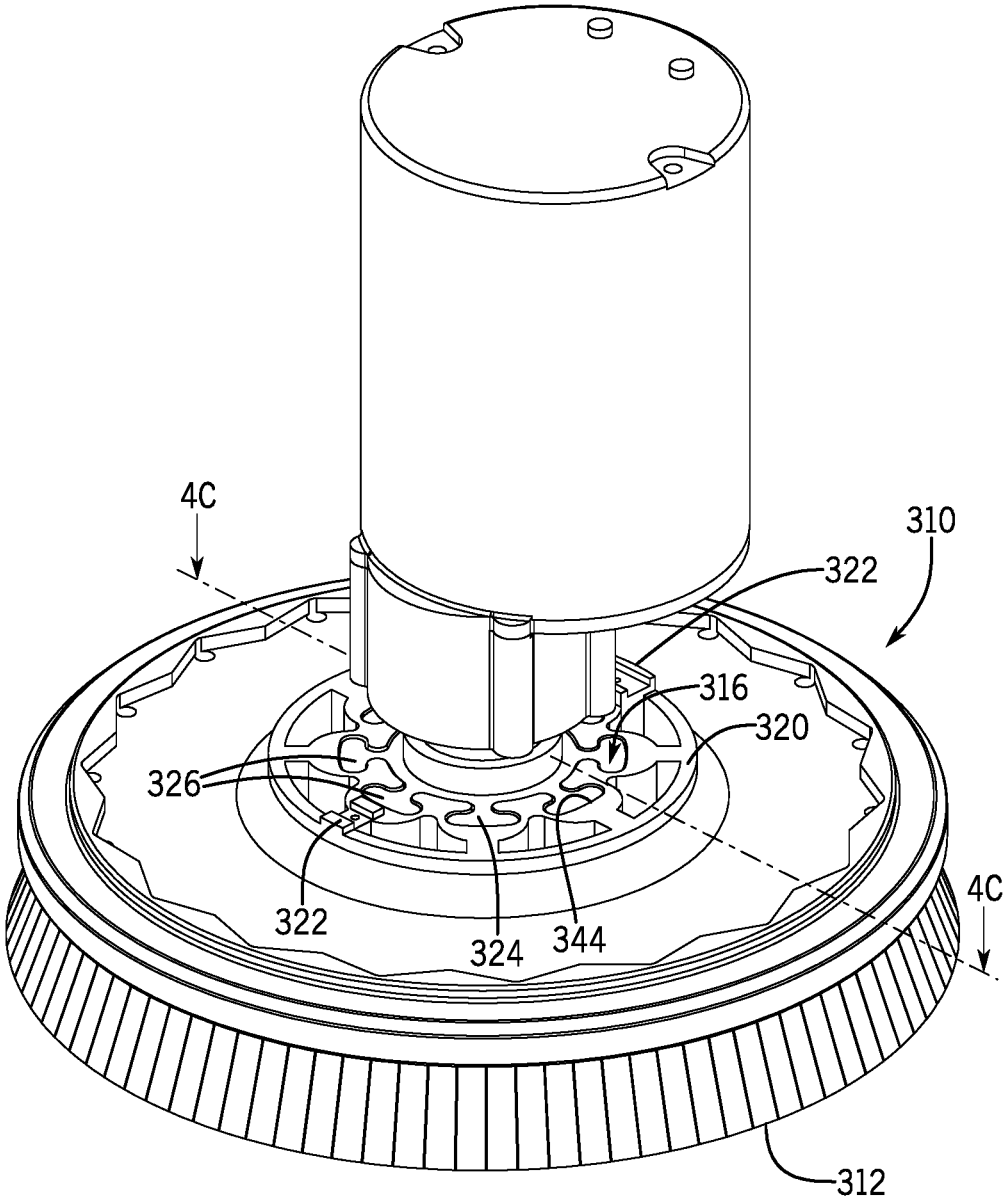
FIG. 4A is a perspective view of a second embodiment of a disc brush including T-shaped pockets on the mating interface (and omitting the retention clips on the disc brush) in which a driver of the floor maintenance machine is received in the female portion of the disc brush.
Figure 4B:
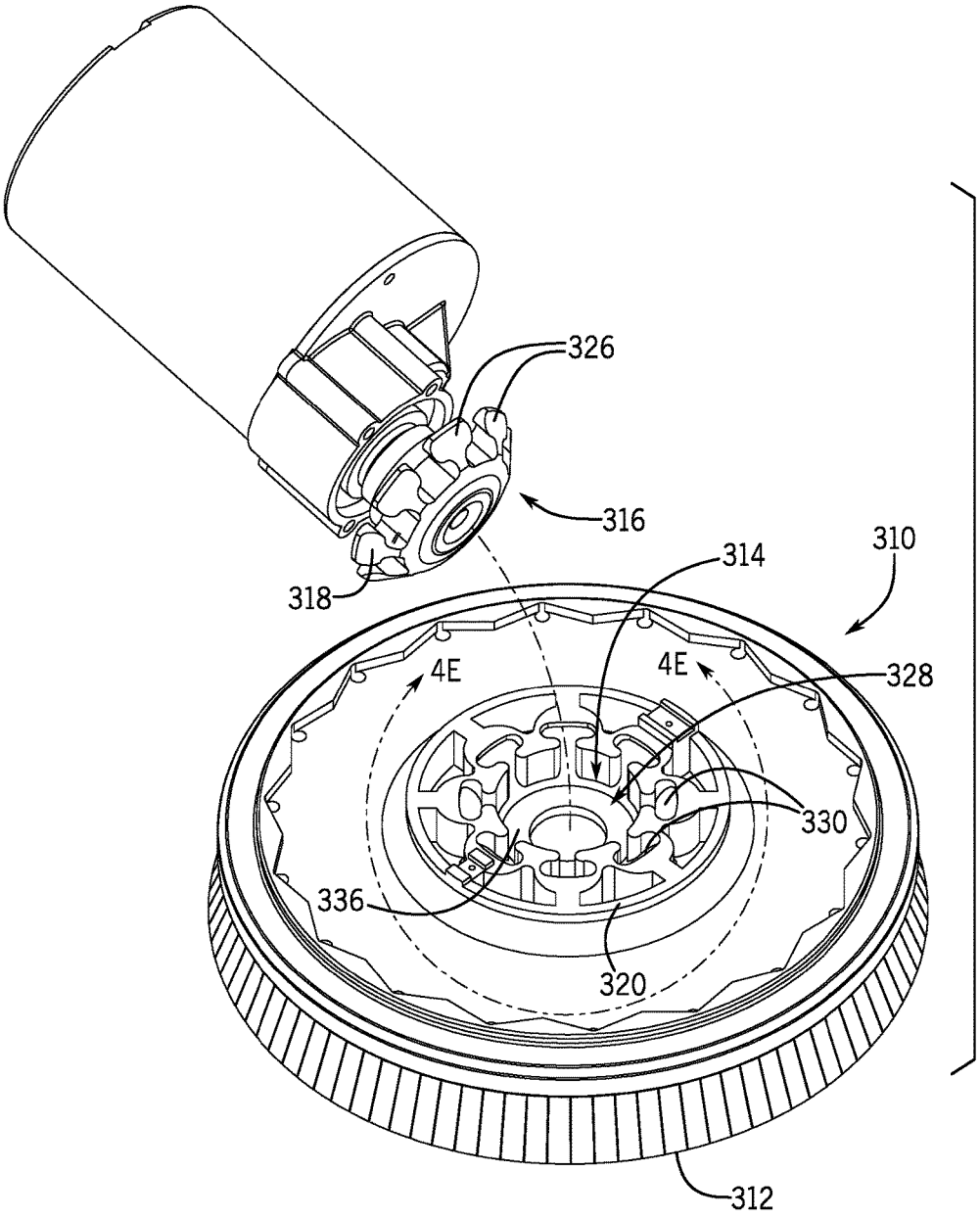
FIG. 4B is a perspective view of the disc brush of FIG. 4A in which the driver and corresponding motor are exploded therefrom to illustrate the mating interfaces of the disc brush and the driver.
Figure 4C:
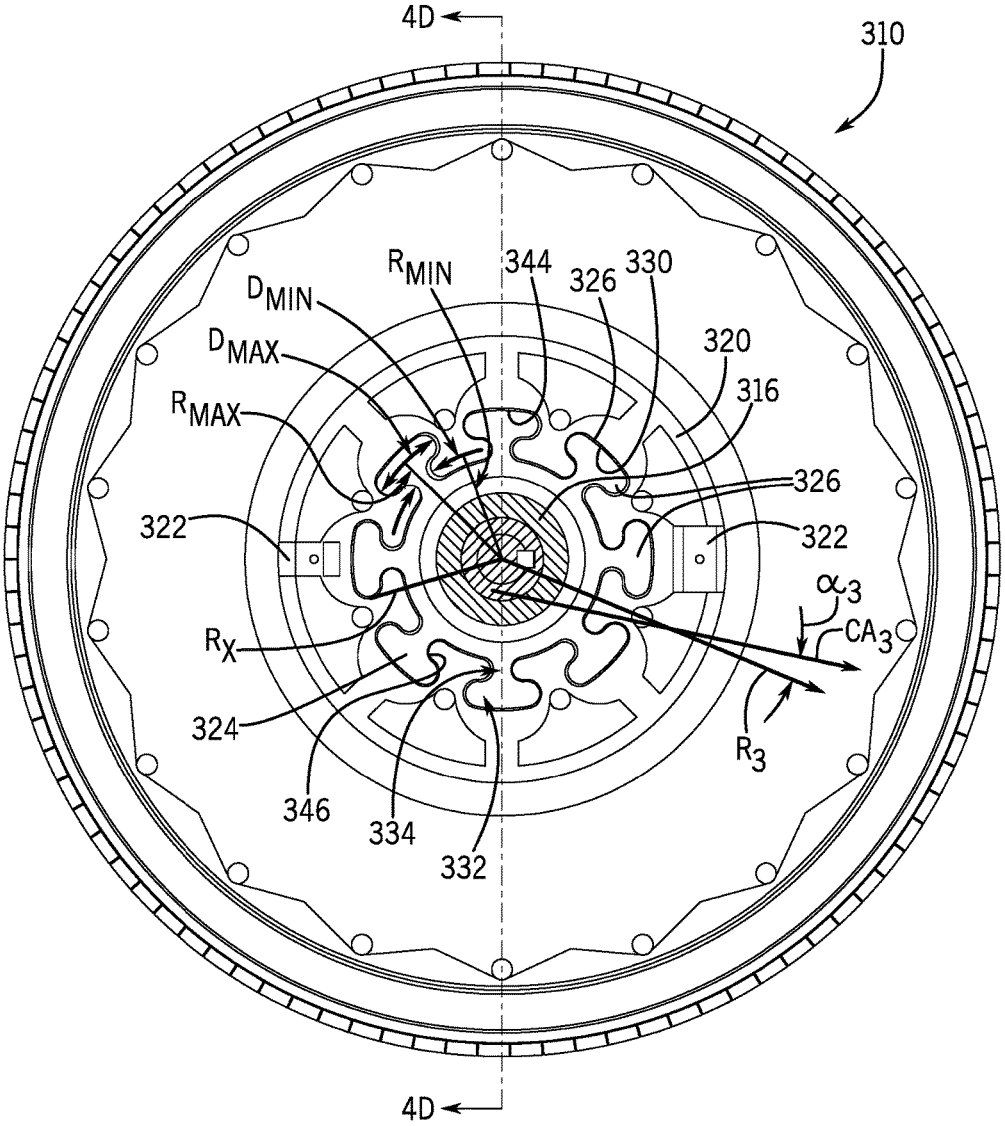
FIG. 4C is a cross-sectional top-down view of the disc brush of FIG. 4A with the driver received therein taken through line 4C-4C of FIG. 4A.
Figure 4D:
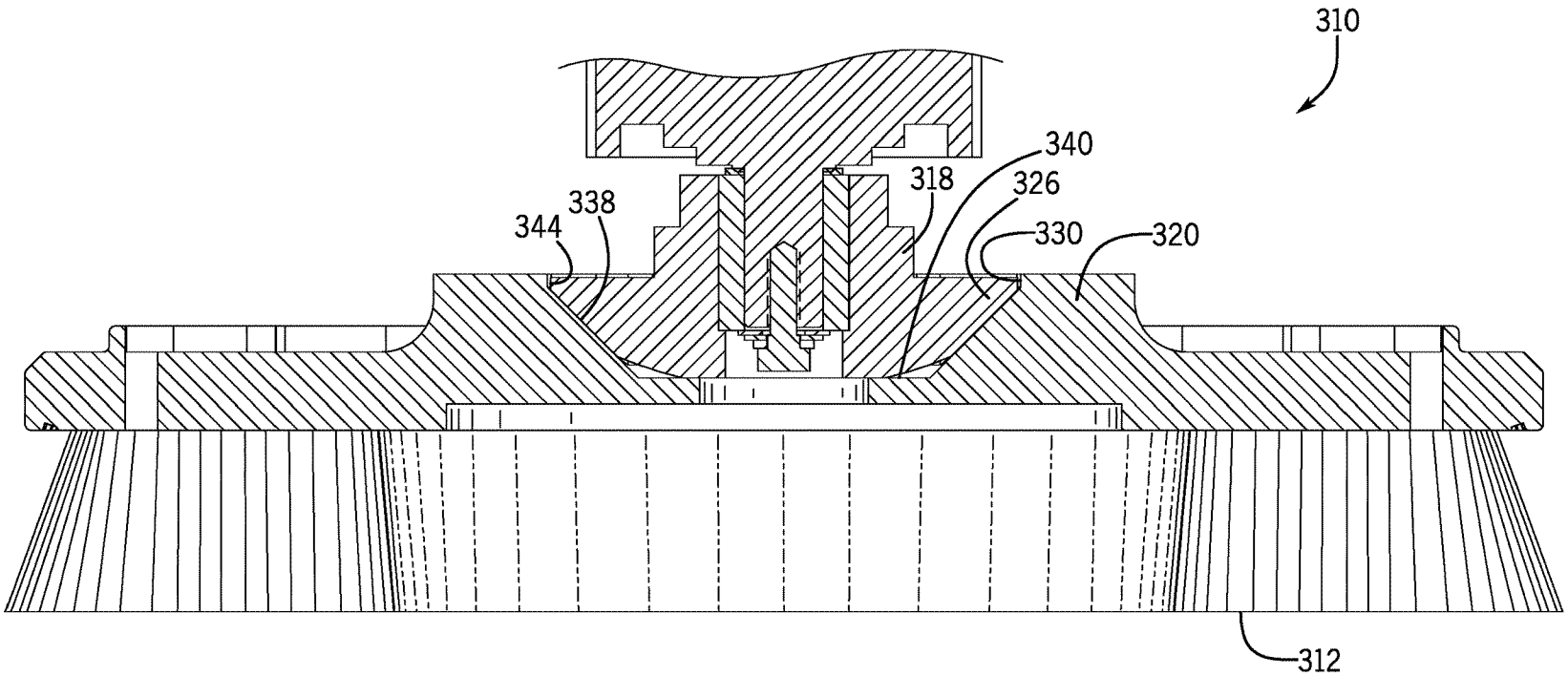
FIG. 4D is a cross-sectional side view of the disc brush of FIG. 4A with the driver received therein taken through line 4D-4D of FIG. 4C.
Figure 4E:
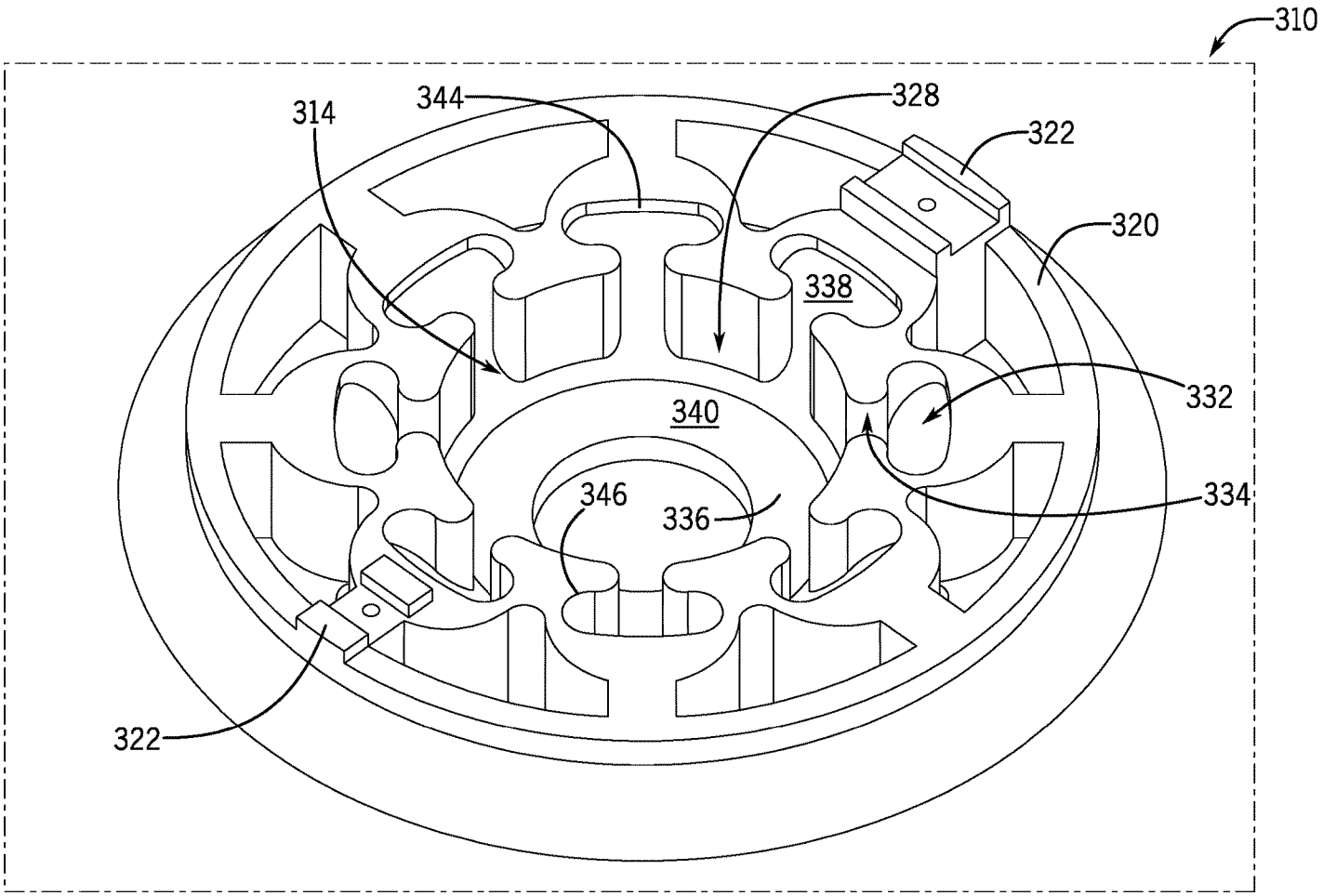
FIG. 4E is a detailed perspective view of the female portion of the mating interface of the disc brush of FIG. 4A.

Another minor difference between the earlier disc brush 210 of FIGS. 3A-3E and the disc brush 310 of FIG. 4A-4E is that the bottom wall 336 of the female portion 314 is slightly differently shaped. As best illustrated in FIG. 4E, the frusto-conical walls 338 slope downward to an axially facing wall 340 and the transition between these two surfaces occur in the central recess 328. In comparison to FIG. 3E, the frusto-conical surfaces 238 transitions into the axially facing wall 240 in the respective neck sections 234. It will be appreciated that the particular shape of the bottom wall 236 may be modified in a number of ways and, because the function of the bottom wall is primarily to locate the driver within the recess of the core, if a change to the bottom wall is made, a corresponding change may be appropriate in the mating driver.

Again, in contrast with the prior art design in FIG. 2C, in the geometry illustrated in FIG. 4C with the driver 318 being driven in the counter-clockwise direction, a line $CA_3$ defines the plane perpendicular to force between the driver 318 and the brush 310 that also defines a third angle $\alpha_3$ with the radius $R_3$. With this geometry of contact, the force vector applied by the driver 318 on the disc brush 310 has a component perpendicular to the radial direction $R_3$ to transmit torque, but also a component that is radially inward from the point of contact. Again, put another way, this angle $\alpha_3$ can be said to lead or to be positive on the radially outward side of the point of contact. Unlike the prior art arrangement, this undercut type of arrangement again causes the cogs or teeth to engage the pockets and cause a type of inter-locking engagement in which rotationally driving the driver 318 does not result in slippage as in the prior art design of FIG. 2C, but rather causes more robust engagement or snagging on the two components together with one another under rotation.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A floor cleaning implement for use in a floor maintenance machine, the floor cleaning implement comprising:

a core providing a female portion of a mating interface which includes a central recess with a plurality of pockets extending radially outward from the central recess, each of the plurality of pockets having a head section that is radially distal from the central recess and having a neck section that is radially intermediate the respective head section and the central recess;

wherein an angle of a maximum angular extent of each head section is greater than an angle of a minimum angular extent of the corresponding neck section.

2. The floor cleaning implement of claim 1, wherein the female portion is defined at least in part by an inner periphery and wherein, the head section of each one of the plurality of pockets includes a section of the inner periphery that faces radially outward and away from the central recess.

3. The floor cleaning implement of claim 1, wherein, in each of the plurality of the pockets, a minimum angular extent of the neck section at a first fixed radial distance from a central axis of the central recess is less than a maximum angular extent of the head section at a second fixed radial distance from the central axis of the central recess.

4. The floor cleaning implement of claim 3, wherein a straight radial line drawn between at least one of the ends of the maximum angular extent of the head section and the central axis does not extend through the minimum angular extent of the neck section and an end thereof.

5. The floor cleaning implement of claim 3, wherein a straight radial line drawn between at least one of the ends of the maximum angular extent of the head section and the central axis does extend through a body of the core.

6. The floor cleaning implement of claim 1, wherein the floor cleaning implement is a disc brush having a brush face that is downwardly facing for contact with a surface to be cleaned.

7. The floor cleaning implement of claim 6, wherein the brush face is generally perpendicular to a central axis of the core.

8. The floor cleaning implement of claim 6, wherein the floor cleaning implement includes a plurality of axially-extending bristles supported by the core that form a brush and the terminal ends of the plurality of axially-extending bristles defining the brush face.

9. The floor cleaning implement of claim 1, wherein the female portion of the mating interface on the core is configured to mate with a male portion of a driver of the floor cleaning machine which has a plurality of cogs corresponding to the plurality of pockets.

10. The floor cleaning implement of claim 1, wherein the plurality of pockets have a T-shaped profile as viewed axially from a top side of the core.

11. The floor cleaning implement of claim 1, wherein the plurality of pockets have a bulbous profile as viewed axially from a top side of the core.

12. The floor cleaning implement of claim 11, wherein the bulbous profile includes a circular segment extending at least 180 degrees about an axis extending through the respective head section.

13. The floor cleaning implement of claim 1, wherein the female portion of the mating interface includes a bottom wall including a downwardly sloping frusto-conical surface and a centrally-located axially facing surface.

14. The floor cleaning implement of claim 13, wherein the downwardly sloping frusto-conical surface extends from the plurality of pockets into the central recess and wherein the centrally-located axially facing surface is located entirely within the recess.

15. The floor cleaning implement of claim 1, wherein an inner periphery of the female portion is parallel to a central axis.

16. The floor cleaning implement of claim 1, wherein the core includes a pair of clip receiving structures on a top side thereof.

17. The floor cleaning implement of claim 1, wherein the plurality of pockets are evenly angularly spaced about a central axis of the central recess.

18. The floor cleaning implement of claim 1, wherein each of the plurality of pockets is symmetrical about a respective plane running centrally therethrough in which the plane also extends through a central axis of the central recess.

19. The floor cleaning implement of claim 1, wherein the core is connected to another body, and the core and the other body together provide the floor cleaning implement.

20. The floor cleaning implement of claim 1, wherein an undercut is formed in each of the plurality of pockets between the maximum angular extent of the head section and the minimum angular extent of the corresponding neck section and wherein the respective undercuts provide surfaces for contact with a geometrically-corresponding driver of the floor maintenance machine such that, when the driver rotates the floor cleaning implement, force vectors applied by the driver on the floor cleaning implement along the undercuts have both a component perpendicular to a radial direction to transmit torque and also a component that is radially inward to promote inter-locking engagement of the driver with the floor cleaning implement during rotation.

21. A disc brush for use in a floor maintenance machine in which the disc brush has a brush face that is downwardly facing for contact with a surface to be cleaned, in which the disc brush is rotatable about a central axis that is perpendicular to the brush face by a driver of the floor maintenance machine in which the driver includes a plurality of radially-extending cogs, and in which, on an axial side of the disc brush opposing the brush face, the disc brush has a female portion of a coupling interface which is configured to receive the driver, the disc brush comprising:

a core providing the female portion which includes a central recess with a plurality of pockets extending radially outward from the central recess that are shaped to correspond to the plurality of radially-extending cogs of the driver, each of the plurality of pockets having a head section that is radially distal from the central recess and having a neck section that is radially intermediate the respective head section and the central recess;

wherein, in each of the plurality of the pockets, an angle of a minimum angular extent of the neck section at a first radial distance passing through the neck section is less than an angle of a maximum angular extent of the head section at a second radial distance passing through the head section.

22. The disc brush of claim 21, wherein an undercut is formed in each of the plurality of pockets between the maximum angular extent of the head section and the minimum angular extent of the corresponding neck section and wherein the respective undercuts provide surfaces for contact with the driver of the floor maintenance machine such that, when the driver rotates the disc brush, force vectors applied by the driver on the disc brush along undercuts have both a component perpendicular to a radial direction to transmit torque and also a component that is radially inward to promote inter-locking engagement of the driver with the disc brush during rotation.

* * * * *